United States Patent [19]

Guerra

[11] Patent Number: 4,860,181

[45] Date of Patent: Aug. 22, 1989

[54] LIGHT SHIELD-REFLECTOR FOR A LIGHTING IMPLEMENT

[75] Inventor: Gianfranco Guerra, Padua, Italy

[73] Assignee: iGuzzini Illuminazione, S.p.A., Recanati (Macerate), Italy

[21] Appl. No.: 192,380

[22] Filed: May 10, 1988

[30] Foreign Application Priority Data

Sep. 15, 1987 [IT] Italy ..... 22336/87[U]

[51] Int. Cl.[4] ..... F21V 7/02

[52] U.S. Cl. ..... 362/290; 362/297; 362/342; 362/346; 362/433

[58] Field of Search ..... 362/290, 291, 297, 298, 362/342, 346, 443, 448, 432, 433

[56] References Cited

U.S. PATENT DOCUMENTS

| | | | |
|---|---|---|---|
| 1,397,793 | 11/1921 | Blackett | 362/291 |
| 1,637,608 | 8/1927 | Ehrlichman | 362/291 |
| 2,267,796 | 12/1941 | Lezebnick | 362/291 |
| 3,593,014 | 7/1971 | Vesely | 362/291 |
| 4,096,555 | 6/1978 | Lasker | 362/342 |
| 4,293,898 | 10/1981 | Budnovitch et al. | 362/342 |

*Primary Examiner*—Ira S. Lazarus
*Assistant Examiner*—Richard R. Cole
*Attorney, Agent, or Firm*—Hedman, Gibson, Costigan & Hoare

[57] ABSTRACT

The light shield-reflector for a lighting implement comprising a substantially tubular base associated with a reflector element of multiple type constituted by a set of superimposed wings spaced apart from each other. The structure of the wings shows substantially a "U"-shaped plan and a parabolic cross-section. The light flux forms a cone-shaped light and diffuses by passing through the space existing between two adjacent wings.

6 Claims, 5 Drawing Sheets

LIGHT SHIELD-REFLECTOR FOR A LIGHTING IMPLEMENT

The object of the present invention is a light shield-reflector for a lighting implement comprising a substantially tubular base, provided with a first end and with a second end, and destined to be assembled in such a way as to surround the socket shell engaged by the relevant bulb of the lighting implement, with the first end of said base being associated with a fastening flange, the second end of said base being associated with a reflector element of the multiple type, wherein the main axes of the base, of the reflector element, of the socket shell and of the bulb are coincident with the main axis of the same implement, with said main axis being also perpendicular to said fastening flange.

Light shield-reflectors are already known, only for vertical-axis lighting equipment, wherein the reflector element of the multiple type is requested to cooperate with a bulb having its base directed downwards, or upwards.

Such light shield-reflectors mainly show the characteristics of:

directing downwards the light beam emitted by the light source, which otherways would be dispersed upwards and sideways, improving the overall efficiency of the lighting equipment they are associated with;

eliminating the dazzlement effect due, in case of the traditional reflectors, to the absence of a bulb shielding.

But such light shield-reflectors cannot be used with satisfactory results in case of horizontal-axis lighting equipment. Such lighting equipment has the advantage of being particularly suitable for wall mounting, with, in most cases, the use of support structures being avoided.

The purpose of the present invention consists in providing a reflector which is of the light shield type, and can be simultaneously associated with a lighting equipment of horizontal type.

Such purpose is achieved by a light shield-reflector for a lighting implement comprising a substantially tubular base equipped with a first end and with a second end, and destined to be mounted in such a way as to surround the socket shell engaged by the relevant bulb of the lighting implement, with the first end of said base being associated with a fastening flange, the second end of said base being associated with a reflector element of multiple type, wherein the main axes of the basis, of the reflector element, of the socket shell and of the bulb are coincident with the main axis of the same implement, with said axis being also perpendicular to said fastening flange, characterized in that the reflector element of multiple type is constituted by a set of superimposed wings spaced apart from each other, whose structure shows a substantially "U"-shaped plan, and a parabolic cross-section.

The advantages achieved by the use of a reflector according to the present invention consist essentially in that a lighting implement can be obtained, which simultaneously offers the advantages of a vertical-axis lighting equipment with a reflector of light-shield type, and those of a horizontal-axis implement, but obviating the drawbacks of both equipment types.

The invention is disclosed in greater detail in the following disclosure, with the aid of the drawings which represent an example of practical embodiment thereof.

Figure 1:
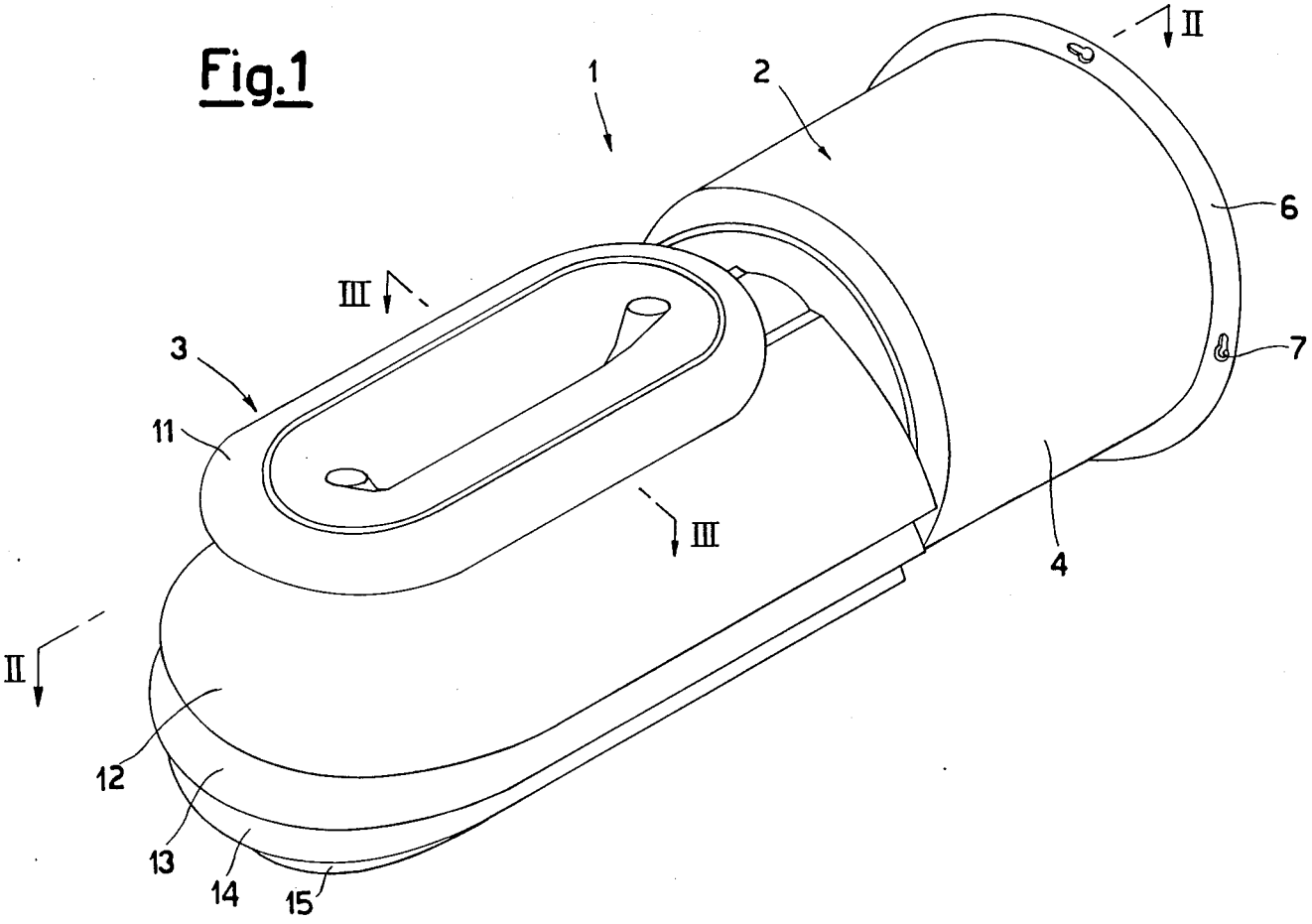
FIG. 1 shows a perspective view of a light shield-reflector of the invention.
Figure 2:
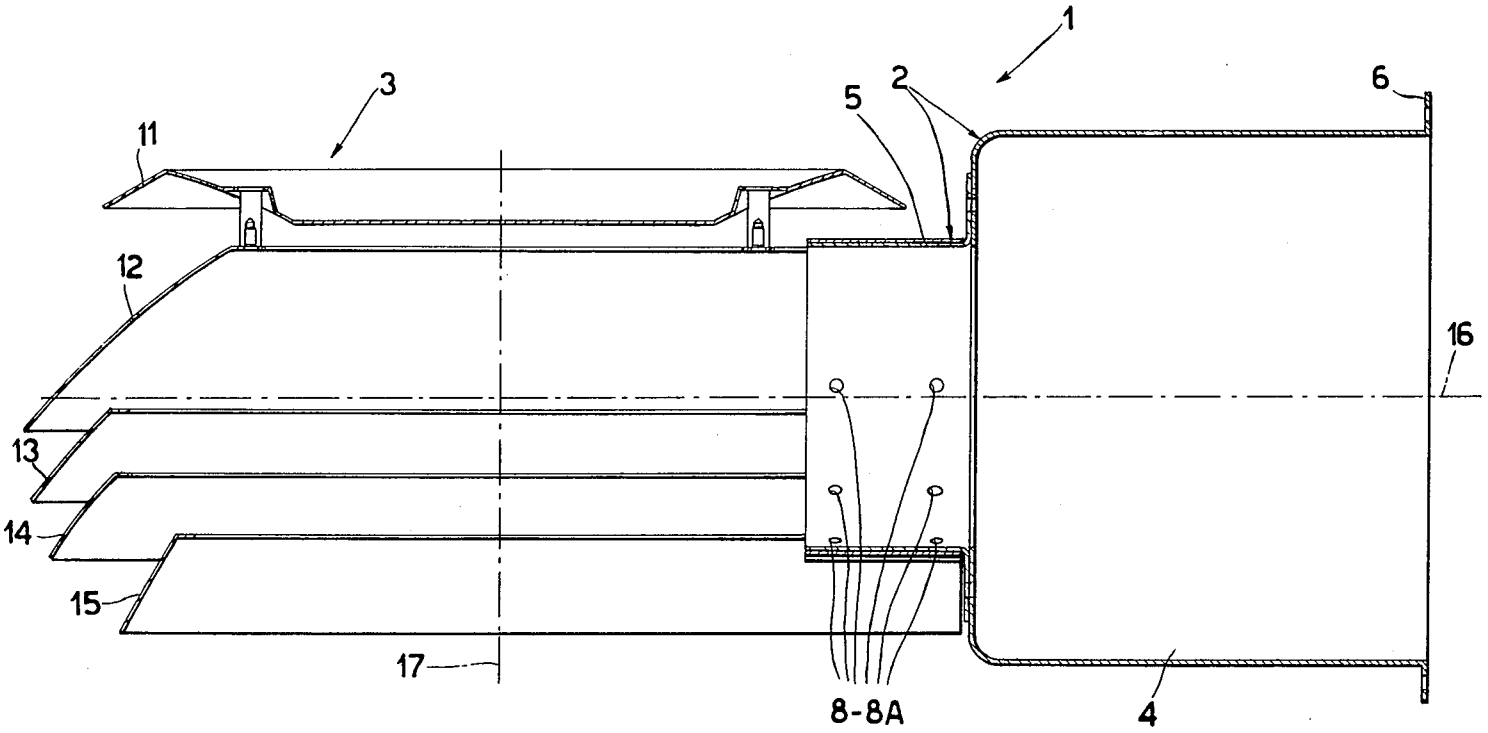
FIG. 2 shows a sectional view according to path II—II of FIG. 1.
Figure 3:
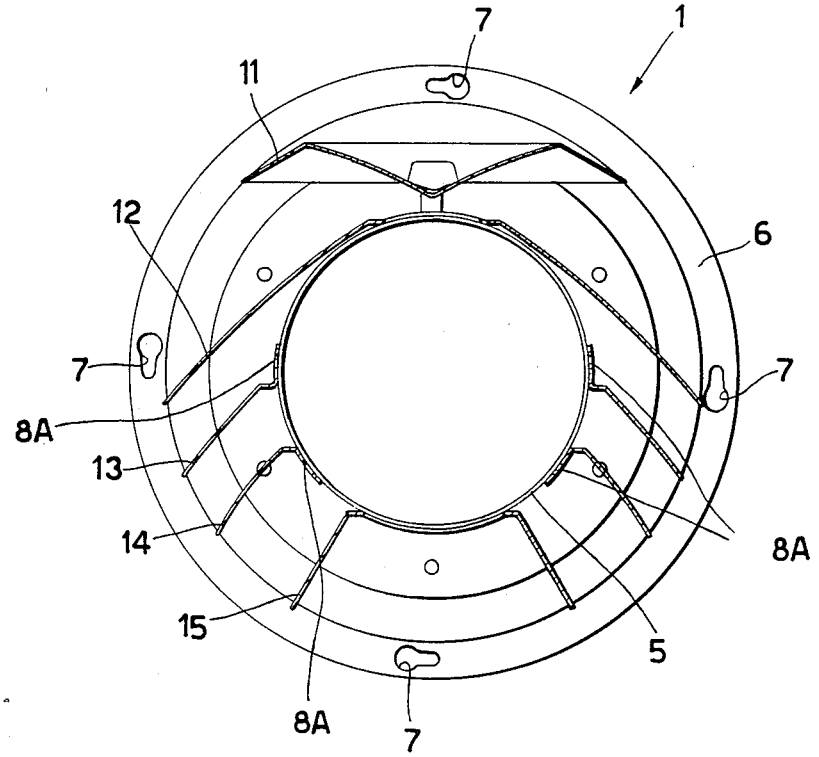
FIG. 3 shows a sectional view according to path III—III of FIG. 1.
Figure 4:
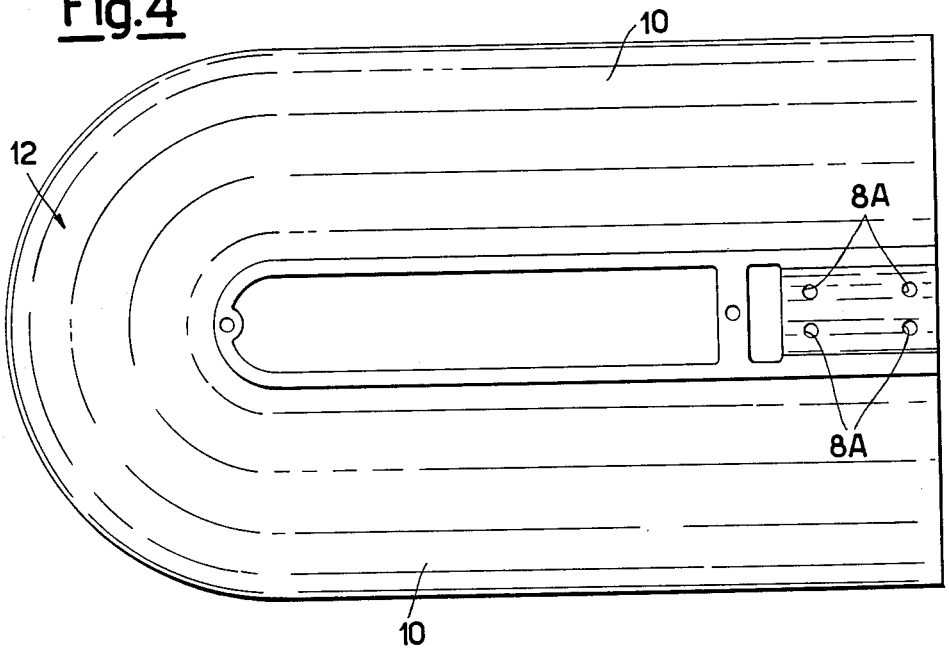
FIGS. 4–7 show plan views of the wings respectively indicated by the reference numerals 12–15, which form the reflector.
Figure 5:
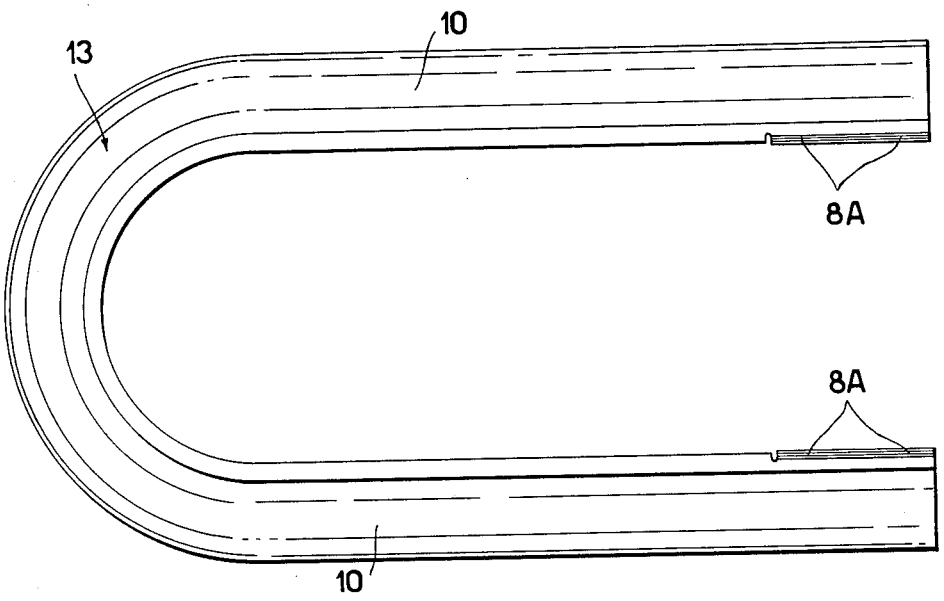
Figure 6:
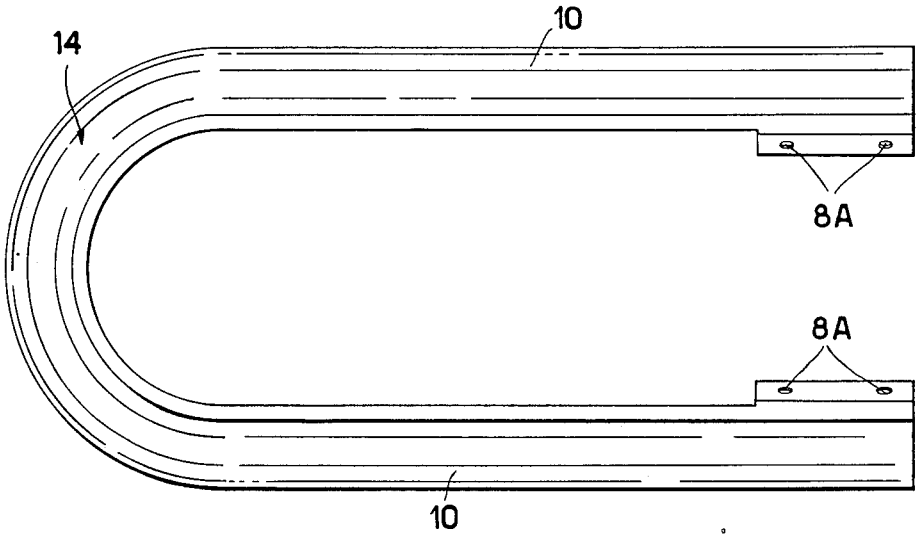
Figure 7:
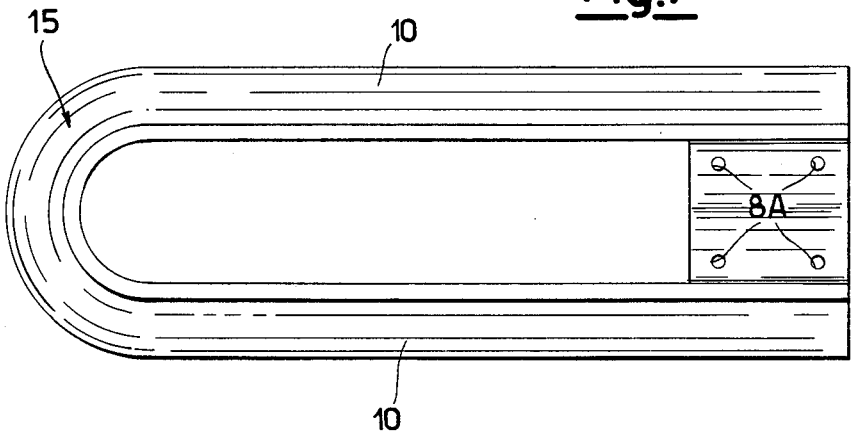

Referring to the above cited figures, the light shield-reflector of the invention, generally indicated by the reference numeral 1 comprises a base 2, containing a bulb and a relevant socket shell (not shown) and a reflector element of light shield type 3.

The base 2 is formed, in its turn, by a case 4 having a cylindrical structure, and a sleeve 5, also having a cylindrical structure, mutually connected in correspondence of one of their ends.

The other end of the case 4 is associated with a circular flange 6 provided with through-bores 7 for fastening in its end position the relevant lighting equipment, which usually takes place on a vertical surface (not shown in the drawings).

The sleeve 5 has on its side surface pairs of through-bores 8, whose function will be evident in the following.

The reflector element of light-shield type 3 is of the multiple type, and comprises a set of essentially "U"-shaped wings indicated by the reference numerals from 11 to 15.

Each wing, excluding the wing indicated by the reference numeral 11, better disclosed in the following, is therefore provided with a pair of parallel arms 10 radiused at an end, whilst the non-connected ends are provided with a pair of bores 8A corresponding to the pairs of bores 8 provided on the sleeve 5. Said couples of bores 8 and 8A are destined to be jointly engaged by fastening means (e.g., rivets) (not shown in the figures).

The cross-section of the parallel arms 10 has a parabolic outline.

Each pair of parallel arms 10 of each wing 12–15 results hence to be associated with a parabola of a different equation, according to the position of the couple of arms relatively to the light source constituted by a bulb (not shown in the figures).

The wing indicated by the reference number 11, which is located at the opposite end relatively to the direction of the light flux exiting the reflector element 3, is constituted by a plate having a substantially ellipsoidal plan, and an also parabolic cross-section.

When the light shield-reflector 1 is assembled with the remaining elements of the lighting implement, the main axis of the base 2, the main axis of the reflector element 3, the main axis of the socket shell and the main axis of the bulb coincide with a main axis 16 of the lighting implement, which is perpendicular to the flange 6.

In operation, the light emitted by the bulb is reflected by the surfaces of the reflector element 3 which are opposite to it, addressing the light flux in such a way as to form a light cone with the axis 17 perpendicular to the main axis 16 of the lighting implement, and which diffuses also by passing through the space existing between two adjacent wings of wings 11–15.

What is claimed:

1. A lighting implement comprising:

(a) a tubular base element having an end forming a support section; and (b) a reflector having one of its ends fastened to said support section of said base element and projecting therefrom, said reflector includes a plurality of superimposed spaced apart wings with a U-shaped downwardly sloping configuration, and a parabolic cross section, surrounding a source of light so that the light diffuses in a downward direction through the spaces defined by said U-shaped wings;

wherein said base element has a first main axis and said reflector has a second main axis, both of said axes being coincident with each other, and said U-shaped wings lying in planes which are parallel to both of said main axes.

2. The device of claim 1, wherein each said U-shaped wings comprises two parallel arms with a pair of bores on their non-connected ends.

3. The device of claim 1, wherein said base comprises a cylindrical case having a fastening flange at its other end and a cylindrical sleeve which is fastened to said reflector.

4. The device of claim 3, wherein said cylindrical sleeve has pairs of bores along its surface which correspond to an equal number of bore pairs provided on said wings, with both of said bore pairs jointly engaged by fastening elements for connecting said light shield wings to said sleeve.

5. The device of claim 4, wherein said parabolic cross section of each wing varies as a function of the position of each wing relative to the light source.

6. The device of claim 5, wherein a plate having a substantially oval plane and a parabolic cross section is positioned at an end opposite that of the direction of light.

* * * * *